US008120603B2

(12) United States Patent
Hsiao

(10) Patent No.: US 8,120,603 B2
(45) Date of Patent: Feb. 21, 2012

(54) DRIVER APPARATUS FOR DISPLAY

(75) Inventor: Chao-Chih Hsiao, Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 488 days.

(21) Appl. No.: 12/369,743

(22) Filed: Feb. 12, 2009

(65) Prior Publication Data

US 2010/0103163 A1 Apr. 29, 2010

(30) Foreign Application Priority Data

Oct. 28, 2008 (TW) ..... 97141463 A

(51) Int. Cl.
*G09G 3/36* (2006.01)

(52) U.S. Cl. ..... 345/214

(58) Field of Classification Search ..... None
See application file for complete search history.

(56) References Cited

U.S. PATENT DOCUMENTS 5,841,311 A * 11/1998 Koike ..... 327/361
6,121,945 A * 9/2000 Tanaka et al. ..... 345/94
2005/0088397 A1* 4/2005 Yu et al. ..... 345/100
2005/0225354 A1* 10/2005 Chang ..... 326/81
2007/0296682 A1* 12/2007 Hwang ..... 345/100

FOREIGN PATENT DOCUMENTS

JP 2005086862 A * 3/2005

* cited by examiner

*Primary Examiner* — Will J Klimowicz
*Assistant Examiner* — Mark Fischer
(74) *Attorney, Agent, or Firm* — Jianq Chyun IP Office

(57) ABSTRACT

A driver apparatus applied on a display is disclosed. The driver apparatus includes a voltage converter, an input level shift circuit, at least one input logic circuit, and at least one output level shifter. The voltage converter receives a first voltage, a ground voltage, and a second voltage, and generates an internal voltage according to the first voltage, the ground voltage, and the second voltage. The input level shift circuit receives an input signal, and generates a level shift input signal transiting between the first voltage and the second voltage according to the input signal. The input logic circuit receives the internal voltage, and generates an internal output signal transiting between the internal voltage and the second voltage according to the level shift input signal. The output level shifter generates a driving signal transiting between a third voltage and the second voltage according to the internal output signal.

12 Claims, 3 Drawing Sheets

DRIVER APPARATUS FOR DISPLAY

CROSS-REFERENCE TO RELATED APPLICATION

This application claims the priority benefit of Taiwan application serial no. 97141463, filed Oct. 28, 2008. The entirety of the above-mentioned patent application is hereby incorporated by reference herein and made a part of specification.

BACKGROUND OF THE INVENTION

1. Field of the Invention

The present invention generally relates to a driver apparatus, in particular, to a gate driver apparatus of a liquid crystal display (LCD).

2. Description of Related Art

With the development of electronic technology, more and more multimedia devices with audio and video playback functions are provided. To both ensure the audio and video quality and reduce the cost and price of these products, many driving modes and circuits of displays have been developed. The displays include normal liquid crystal displays (LCDs), light emitting diode (LED) displays, and vacuum fluorescent displays (VFDs).

However, the driver apparatus of any of the above displays must provide a driving signal at a high voltage level for driving the corresponding display panel. Normally, a plurality of level shifters is needed to generate the driving signal at a high voltage level. FIG. 1 is a block diagram of a conventional gate driver apparatus 100 of an LCD. Referring to FIG. 1, a logic circuit 110 receives an input signal IP, and generates an internal control signal. The internal control signal is transmitted to a shift register 120. The logic circuit 110 and the shift register 120 are both formed by logic circuits, and thus operate in a relatively low voltage range (voltage VDD to GND).

To generate the driving signal at a voltage high enough to drive the display, a level shifter 130 transforms the voltage level of the internal control signal to between the voltage VDD and a voltage VEE, and a level shifter 140 transforms the voltage level of the internal control signal to between a voltage VCC and the voltage VEE. The voltage VEE is lower than the voltage GND, and the voltage VCC is higher than the voltage VDD. The gate driver apparatus 100 must drive the display on different channels, and the number of the required level shifters 130 and 140 is in direct proportion to the number of the channels. Therefore, the level shifters 130 and 140 occupy a large circuit area.

SUMMARY OF THE INVENTION

Accordingly, the present invention is directed to a driver apparatus suitable for driving a display. The driver apparatus requires fewer level shifters, and may reduce the circuit area.

A driver apparatus applicable to a display includes a voltage converter, an input level shift circuit, at least one input logic circuit, and at least one output level shifter. The voltage converter receives a first voltage, a ground voltage, and a second voltage, and generates an internal voltage according to the first voltage, the ground voltage, and the second voltage. The input level shift circuit receives an input signal, and generates a level shift input signal transiting between the first voltage and the second voltage according to the input signal. The at least one input logic circuit is coupled to the input level shift circuit and the voltage converter. The input logic circuit receives the internal voltage, and generates an internal output signal according to the level shift input signal. The internal output signal transits between the internal voltage and the second voltage. In addition, the at least one output level shifter is coupled to the input logic circuit to receive the internal output signal. The output level shifter generates a driving signal transiting between a third voltage and the second voltage according to the internal output signal.

In an embodiment of the present invention, the driver apparatus further includes a voltage buffer coupled to a path where the voltage converter is coupled to a logic shift register.

In an embodiment of the present invention, the driver apparatus further includes a voltage regulator coupled to a path where the voltage converter is coupled to a logic shift register.

In an embodiment of the present invention, the voltage converter is a subtractor.

In an embodiment of the present invention, the internal voltage=the first voltage−(the ground voltage−the second voltage).

In an embodiment of the present invention, the input logic circuit is a logic shift register circuit.

In an embodiment of the present invention, the input signal transits between the first voltage and the ground voltage.

In an embodiment of the present invention, when the input signal is at the first voltage, the level shift input signal is at the first voltage, and when the input signal is at the ground voltage, the level shift input signal is at the second voltage.

In an embodiment of the present invention, when the input signal is at the first voltage, the level shift input signal is at the second voltage, and when the input signal is at the ground voltage, the level shift input signal is at the first voltage.

In an embodiment of the present invention, the driver apparatus further includes at least one output circuit coupled to the output level shifter for receiving the driving signal and generating a driving output signal according to the driving signal.

In an embodiment of the present invention, the display is a liquid crystal display (LCD).

In an embodiment of the present invention, the driver apparatus is a gate driver apparatus of an LCD.

In the present invention, the internal voltage is generated by the voltage generator, and the transition scope of the input signal is transformed by the input level shift circuit according to the internal voltage. Then, the driving signal for driving the display is converted to the appropriate transition scope by the output level shifter. Through the method for transforming the transition scope of the input signal according to the internal voltage with the input level shift circuit, the number of the level shifter required for shifting the level twice on the output level shifter of the driver apparatus in the prior art is effectively reduced. As such, the circuit area is significantly reduced, and the cost is lowered.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
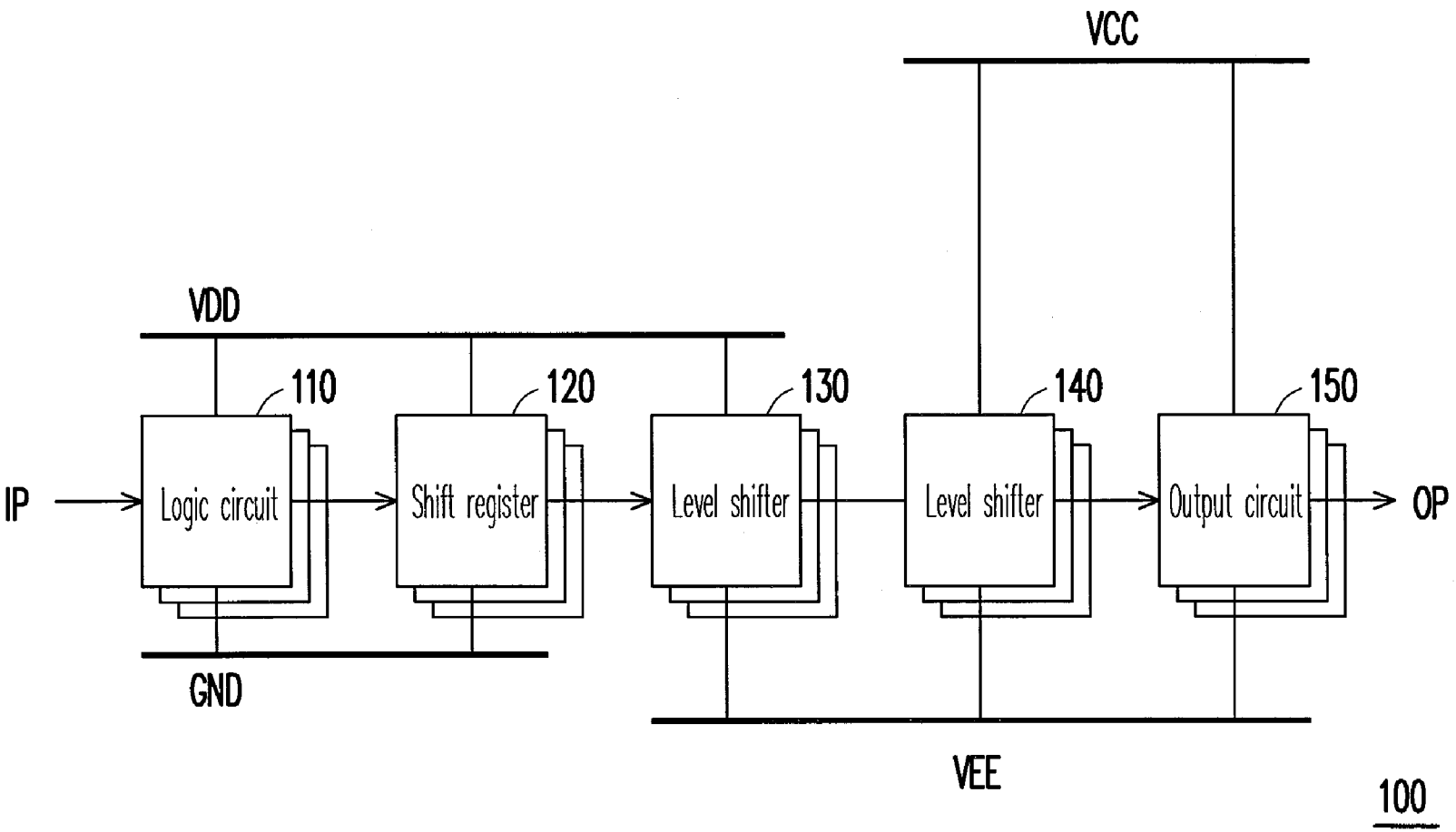
FIG. 1 (PRIOR ART)
FIG. 1 is a block diagram of a conventional gate driver apparatus 100 of an LCD.

Reference will now be made in detail to the present embodiments of the invention, examples of which are illustrated in the accompanying drawings. Wherever possible, the same reference numbers are used in the drawings and the description to refer to the same or like parts.

In order to make those of ordinary skill in the art understand and implement the present invention, embodiments on the driver apparatus of the present invention will be illustrated below with the accompanying drawings.

Figure 2:
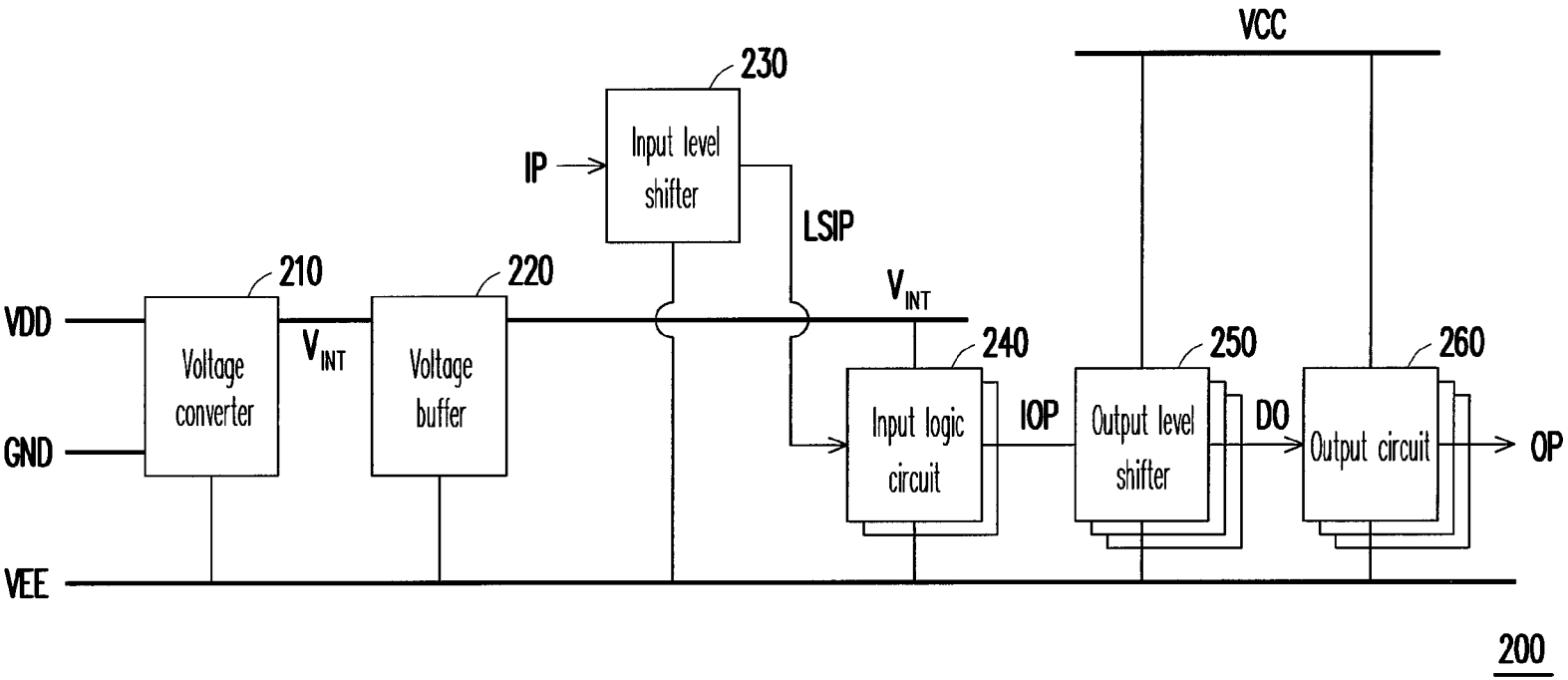
FIG. 2 is a schematic view of a driver apparatus 200 according to an embodiment of the present invention.

FIG. 2 is a schematic view of a driver apparatus 200 according to an embodiment of the present invention. The driver apparatus 200 includes a voltage converter 210, a voltage buffer 220, an input level shift circuit 230, an input logic circuit 240, an output level shifter 250, and an output circuit 260. The voltage converter 210 receives a voltage VDD, a ground voltage GND, and a voltage VEE, and generates an internal voltage $V_{INT}$ according to the voltage VDD, the ground voltage GND, and the voltage VEE. In this embodiment, the internal voltage $V_{INT}$ is generated by adjusting the voltage VDD. The amplitude of the adjustment is the difference between the ground voltage GND and the voltage VEE. In other words, the internal voltage $V_{INT}$=the voltage VDD−(the ground voltage GND−the voltage VEE). It should be noted that the voltage VEE is normally much lower than the ground voltage GND. Generally, the ground voltage is 0 V, and the voltage VEE is a negative voltage sufficient to drive a display (not shown).

The voltage buffer 220 is coupled to the voltage converter 210, so as to provide the internal voltage $V_{INT}$ with enough capability to drive the subsequent input logic circuit 240. The voltage buffer 220 is configured as the driver apparatus normally has to drive display circuits on different channels, i.e., a plurality of input logic circuits 240 is required. To ensure the stable operation of the driver apparatus 200 having the plurality of input logic circuits 240, the voltage buffer 220 must be properly configured. Certainly, if the driver apparatus 200 does not need to drive displays on different channels, the voltage buffer 220 may not necessarily be configured in the driver apparatus 200.

The input level shift circuit 230 receives an input signal IP. In this embodiment, the driver apparatus is a gate driver apparatus of an LCD, and the input signal IP is an internal control signal of the display. Normally, the internal control signal of the display is generated by a timing generator (TG) in the display. The method of generating the internal control signal with the TG is known to those of ordinary skill in the art, and the details will not be described herein again.

As the input signal IP is generated by the logic circuit (i.e., the TG), the input signal IP is a signal transiting between the voltage VDD and the ground voltage GND. The input level shift circuit 230 operates between the voltage VDD and the voltage VEE, and generates a level shift input signal LSIP transiting between the voltage VDD and the voltage VEE.

The input logic circuit 240 is coupled to the input level shift circuit 230, and receives the level shift input signal LSIP. The input logic circuit 240 is further coupled to the voltage buffer 220, and receives the internal voltage $V_{INT}$. The input logic circuit 240 generates an internal output signal IOP transiting between the internal voltage $V_{INT}$ and the second voltage VEE according to the level shift input signal LSIP. Moreover, when the driver apparatus 200 serves as the gate driver of the display, the input logic circuit 240 is a logic shift register.

The internal output signal IOP is output to the output level shifter 250, and the output level shifter 250 accordingly generates a driving signal DO transiting between a voltage VCC and the voltage VEE. The voltage VCC is a positive voltage sufficient to drive the display. Here, more than one output level shifter 250 may be adopted. When the driver apparatus 200 needs to drive the display on different channels, the number of the output level shifter 250 may increase with the number of the channels of the display to be driven.

The output circuit 260, coupled to the output level shifter 250, receives the driving signal DO and generates an output driving signal OP for driving the display. In this embodiment, the number of the output circuit 260 is the same as that of the output level shifter 250, and the output circuit 260 serves as a buffer. The output driving signal OP, the same as the driving signal DO, is also a signal transiting between the voltage VCC and the voltage VEE.

As described above, in the driver apparatus 200 of this embodiment, a plurality of output level shifters 250 may be used, while only one input level shift circuit 230 is employed. Here, the driver apparatus 200 requires much fewer level shifters, and effectively saves the circuit area.

Figure 3:
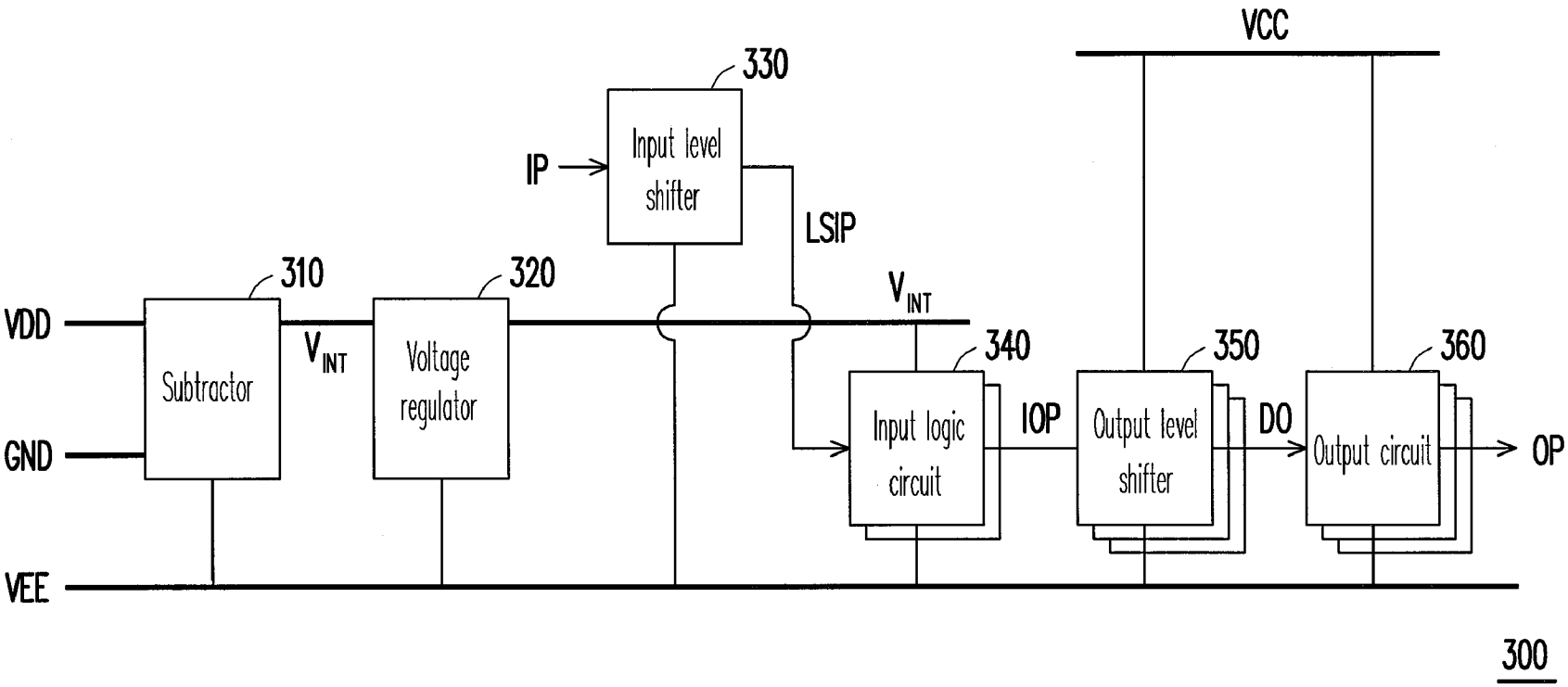
FIG. 3 is a block diagram of a driver apparatus 300 according to another embodiment of the present invention.

FIG. 3 is a block diagram of a driver apparatus 300 according to another embodiment of the present invention. Referring to FIG. 3, different from the above embodiment, the driver apparatus 300 uses a subtractor 310 to generate the internal voltage $V_{INT}$, and a voltage regulator 320 is serially connected between the subtractor 310 and the input logic circuit 340 as the output buffer stage of the internal voltage $V_{INT}$. Then, the operation of the driver apparatus 300 is described below with an actual example. In the example, the voltage VDD is 3.3 V, the ground voltage GND is V, the voltage VEE is −15 V, and the voltage VCC is 12 V.

The subtractor 310 receives the voltage VDD, the ground voltage GND, and the voltage VEE, and generates the internal voltage $V_{INT}$ accordingly. Here, the internal voltage $V_{INT}$=3.3 V−(0 V−(−15 V))=−11.7 V. The input signal IP transits between 3.3 V (the voltage VDD) and 0 V (the ground voltage GND), and the input level shifter 330 generates a level shift input signal LSIP transiting between 3.3 V (the voltage VDD) and −15 V (the voltage VEE) according to the input signal IP. The input logic circuit 340 receives the level shift input signal LSIP, and generates an internal output signal IOP transiting between −11.7 V (the internal voltage $V_{INT}$) and −15 V (the voltage VEE).

In the method for generating the level shift input signal LSIP according to the input signal IP, for example, when the input signal IP is at the voltage VDD, the level shift input signal LSIP is at the voltage VDD, and when the input signal IP is at the ground voltage GND, the level shift input signal LSIP is at the voltage VEE. Or, when the input signal IP is at the voltage VDD, the level shift input signal LSIP is at the voltage VEE, and when the input signal IP is at the ground voltage GND, the level shift input signal LSIP is at the voltage VDD.

The output level shifter 350 receives the internal output signal IOP, and generates a driving signal DO transiting between 12 V (the voltage VCC) and −15 V (the voltage VEE). The output circuit receives the driving signal DO, and generates a driving output signal OP transiting between 12 V (the voltage VCC) and −15 V (the voltage VEE) as well.

In view of the above, the present invention adopts the internal voltage generated by the voltage converter to make the input signal transit between the internal voltage and the second voltage, and then employs the output level shifter to generate the driving voltage transiting between the third voltage and the second voltage, so as to drive the display. Thus, fewer level shifters are required in the driver apparatus, such that the circuit area is reduced, and the cost is significantly lowered.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driver apparatus, applicable to a display, comprising:

a voltage converter, for receiving a first voltage, a ground voltage, and a second voltage, and generating an internal voltage according to the first voltage, the ground voltage, and the second voltage;

an input level shift circuit, for receiving an input signal, and generating a level shift input signal transiting between the first voltage and the second voltage according to the input signal;

at least one input logic circuit, coupled to the input level shift circuit and the voltage converter, for receiving the internal voltage, wherein the input logic circuit generates an internal output signal transiting between the internal voltage and the second voltage according to the level shift input signal; and at least one output level shifter, coupled to the input logic circuit to receive the internal output signal, for generating a driving signal transiting between a third voltage and the second voltage according to the internal output signal, wherein the second voltage<the internal voltage<the first voltage<the third voltage.

2. The driver apparatus according to claim 1, further comprising:

a voltage buffer, coupled to a path where the voltage converter is coupled to the input logic circuit.

3. The driver apparatus according to claim 1, further comprising:

a voltage regulator, coupled to a path where the voltage converter is coupled to the input logic circuit.

4. The driver apparatus according to claim 1, wherein the voltage converter is a subtractor.

5. The driver apparatus according to claim 4, wherein the internal voltage=the first voltage−(the ground voltage−the second voltage).

6. The driver apparatus according to claim 1, wherein the input logic circuit is a logic shift register circuit.

7. The driver apparatus according to claim 1, wherein the input signal transits between the first voltage and the ground voltage.

8. The driver apparatus according to claim 7, wherein when the input signal is at the first voltage, the level shift input signal is at the first voltage, and when the input signal is at the ground voltage, the level shift input signal is at the second voltage.

9. The driver apparatus according to claim 7, wherein when the input signal is at the first voltage, the level shift input signal is at the second voltage, and when the input signal is at the ground voltage, the level shift input signal is at the first voltage.

10. The driver apparatus according to claim 1, further comprising:

at least one output circuit, coupled to the output level shifter to receive the driving signal, for generating a driving output signal according to the driving signal.

11. The driver apparatus according to claim 1, wherein the display is a liquid crystal display (LCD).

12. The driver apparatus according to claim 11, wherein the driver apparatus is a gate driver apparatus of the LCD.

* * * * *